US005857898A

United States Patent [19]

Hiyama et al.

[11] Patent Number: 5,857,898

[45] Date of Patent: Jan. 12, 1999

[54] METHOD OF AND APPARATUS FOR DRESSING POLISHING CLOTH

[75] Inventors: Hirokuni Hiyama, Tokyo; Norio Kimura; Tomoyuki Yahiro, both of Fujisawa, all of Japan

[73] Assignee: Ebara Corporation, Tokyo, Japan

[21] Appl. No.: 974,598

[22] Filed: Nov. 19, 1997

Related U.S. Application Data

[63] Continuation of Ser. No. 683,428, Jul. 18, 1996, abandoned.

[30] Foreign Application Priority Data

Jul. 18, 1995 [JP] Japan ..... 7-203907

[51] Int. Cl.[6] ..... B24B 5/00; B24B 29/00

[52] U.S. Cl. ..... 451/56; 451/57; 451/287; 451/443

[58] Field of Search ..... 451/56, 57, 58, 451/41, 285, 287, 289, 443, 444

[56] References Cited

U.S. PATENT DOCUMENTS

| | | | |
|---|---|---|---|
| 4,016,855 | 4/1977 | Mimata | 451/41 |
| 4,184,908 | 1/1980 | Lackner et al. . | |
| 4,972,630 | 11/1990 | Seki et al. | 451/57 |
| 5,010,692 | 4/1991 | Ishida et al. | 451/56 |
| 5,167,667 | 12/1992 | Prigge et al. . | |
| 5,216,843 | 6/1993 | Breivogel et al. . | |
| 5,320,706 | 6/1994 | Blackwell | 451/41 |
| 5,421,768 | 6/1995 | Fujiwara et al. | 451/285 |
| 5,433,650 | 7/1995 | Winebarger | 451/41 |
| 5,456,627 | 10/1995 | Jackson et al. | 451/57 |
| 5,486,131 | 1/1996 | Cesna et al. | 451/285 |
| 5,536,202 | 7/1996 | Appel et al. | 451/285 |
| 5,545,076 | 8/1996 | Yun et al. | 451/285 |
| 5,578,529 | 11/1996 | Mullins | 451/287 |
| 5,643,067 | 7/1997 | Katsuoka et al. . | |
| 5,651,725 | 7/1997 | Kikuta et al. . | |

FOREIGN PATENT DOCUMENTS

| | | |
|---|---|---|
| 0 537 627 | 4/1993 | European Pat. Off. . |
| 5-208361 | 8/1993 | Japan . |
| 95/18697 | 7/1995 | WIPO . |

*Primary Examiner*—Eileen P. Morgan
*Attorney, Agent, or Firm*—Wenderoth, Lind & Ponack, L.LP.

[57] ABSTRACT

A polishing cloth is dressed between polishing processes each for polishing a workpiece such as a semiconductor wafer. The polishing cloth is dressed while supplying a dressing liquid such as water during a dressing process, and an abrasive liquid for polishing a workpiece is supplied to the polishing cloth for a predetermined period of time prior to a polishing process. The predetermined period of time may be present within the dressing process and immediately precedes the polishing process, and the dressing process may be carried out while supplying the abrasive liquid to the polishing cloth. Alternatively, the predetermined period of time may be present between the dressing process and the polishing process.

14 Claims, 2 Drawing Sheets

METHOD OF AND APPARATUS FOR DRESSING POLISHING CLOTH

This application is a continuation of now abandoned application, Ser. No. 08/683,428, filed Jul. 18, 1996, now abandoned.

BACKGROUND OF THE INVENTION

1. Field of the Invention

The present invention relates to a method of and an apparatus for dressing a polishing cloth, and more particularly to a method of and an apparatus for dressing a polishing cloth which is used to polish a workpiece such as a semiconductor wafer to a flat mirror finish.

2. Description of the Related Art

Recent rapid progress in semiconductor device integration demands smaller and smaller wiring patterns or interconnections and also narrower spaces between interconnections which connect active areas. One of the processes available for forming such interconnection is photolithograpy. Though the photolithographic process can form interconnections that are at most 0.5 $\mu$m wide, it requires that surfaces on which pattern images are to be focused by a stepper be as flat as possible because the depth of focus of the optical system is relatively small.

It is therefore necessary to make the surfaces of semiconductor wafers flat for photolithography. One customary way of flattening the surfaces of semiconductor wafers is to polish them with a polishing apparatus.

Conventionally, a polishing apparatus has a turntable and a top ring which rotate at respective individual speeds. A polishing cloth is attached to the upper surface of the turntable. A semiconductor wafer to be polished is placed on the polishing cloth and clamped between the top ring and the turntable. An abrasive liquid containing abrasive grains is supplied onto the polishing cloth and retained on the abrasive cloth. During operation, the top ring exerts a certain pressure on the turntable, and the surface of the semiconductor wafer held against the polishing cloth is therefore polished to a flat mirror finish while the top ring and the turntable are rotating.

After the workpiece has been polished and before another workpiece is polished, the polishing cloth is processed to recover its original polishing capability. Various processes have been and are being developed for restoring the polishing cloth, and are collectively called "dressing". The polishing cloth is dressed in order to enable the polishing apparatus to perform a good polishing function at all times without undesired degradation of a polishing performance which would otherwise be caused if the polishing cloth were not dressed, but rather used continuously. If the polishing apparatus suffers degradation of polishing performance, then it may not be able to polish a workpiece at a constant polishing rate or to a flat finish, or may cause the polishing cloth to have an unduly short service life.

Since one of purposes for dressing the polishing cloth is to remove a remaining abrasive liquid on the polishing cloth, ground-off chips of the workpiece, and worn pieces of the polishing cloth, it is often dressed while water is being supplied to the polishing cloth for thereby discharging the remaining abrasive liquid, the chips, and the worn pieces from the polishing cloth.

After the polishing cloth has been dressed with water supplied thereto, a new workpiece to be polished is set in place for a new polishing operation. However, the new workpiece cannot be polished at a sufficiently high polishing rate in an initial polishing period because an abrasive liquid is not present on the polishing cloth before the new workpiece starts being polished or the abrasive liquid is diluted with the water that has been supplied in the preceding dressing process and remained on the polishing cloth. It takes a certain period of time until the abrasive liquid is fully distributed over and impregnated in the polishing cloth or the concentration of the abrasive liquid on the polishing cloth increases to a predetermined level.

Since the new workpiece cannot be polished at a sufficiently high polishing rate in the initial polishing period, the total period of time required in each polishing process is relatively long, and hence the processing capability of the polishing apparatus per unit time is relatively low.

Furthermore, inasmuch as the abrasive liquid is not uniformly distributed over and impregnated in the polishing cloth until the abrasive liquid is fully spread over the polishing cloth, the performance of the polishing apparatus tends not to be uniform. Thus, the flatness of the polished workpiece tends to fail to reach a desired level.

SUMMARY OF THE INVENTION

It is therefore an object of the present invention to provide a method of and an apparatus for dressing a polishing cloth for use in a polishing apparatus which can start polishing a workpiece at a sufficiently high polishing rate and polish the workpiece uniformly after the polishing cloth is dressed.

To achieve the above object, according to the present invention, there is provided a method of dressing a polishing cloth between polishing processes each for polishing a workpiece, comprising the steps of: dressing a polishing cloth with a dressing element while supplying a dressing liquid to the polishing cloth; and supplying an abrasive liquid for polishing a workpiece to the polishing cloth for a predetermined period of time prior to a polishing process.

The predetermined period of time may be present within the dressing process and immediately precedes the polishing process, and the dressing process may be carried out while supplying the abrasive liquid to the polishing cloth. The dressing liquid may not be supplied during the predetermined period of time.

Alternatively, the predetermined period of time may be present between the dressing process and the polishing process.

The polishing cloth may be dressed by pressing a dressing element having diamond pellets or a brush against the polishing cloth in the presence of the dressing liquid.

According to the present invention, there is also provided an apparatus for dressing a polishing cloth between polishing processes each for polishing a workpiece, comprising: a dressing head for holding a dressing element to dress a polishing cloth; a dressing liquid supply nozzle for supplying a dressing liquid used to dress the polishing cloth to the polishing cloth in a dressing process; and an abrasive liquid supply nozzle for supplying an abrasive liquid used to polish a workpiece to the polishing cloth in a polishing process; wherein the abrasive liquid is supplied from the abrasive liquid supply nozzle to the polishing cloth for a predetermined period of time prior to the polishing process.

The dressing element may comprise a disk with diamond pellets attached thereto or a disk with a brush attached thereto.

According to the present invention, since the abrasive liquid which is used to polish the workpiece is supplied to the polishing cloth prior to the polishing process, the abrasive liquid is present on the polishing cloth at the time the polishing process is started. Consequently, the workpiece can start being polished at a sufficiently high polishing rate in the polishing process.

Furthermore, since the polishing cloth is processed by the mechanical action of dressing, the abrasive liquid supplied to the polishing cloth can be well distributed over and impregnated in the polishing cloth.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
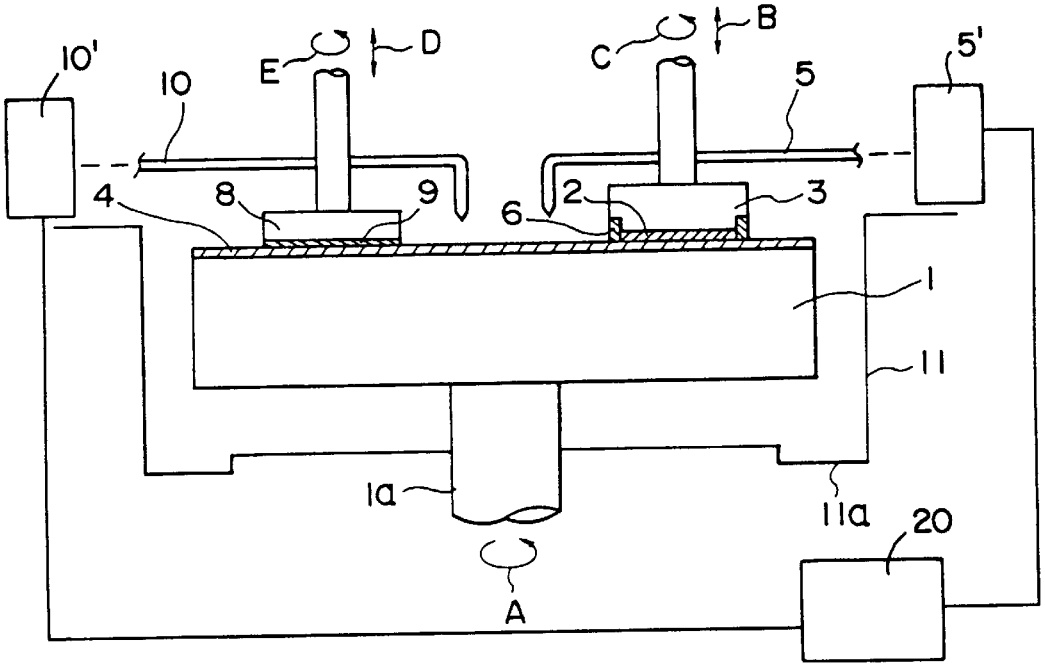
FIG. 1 is a schematic representation of a vertical cross-sectional view of a polishing apparatus on which a dressing method according to the present invention is carried out.

A dressing method according to the present invention is carried out on a polishing apparatus as shown in FIG. 1.

As shown in FIG. 1, the polishing apparatus comprises a turntable 1, and a top ring 3 positioned above the turntable 1 for holding a semiconductor wafer 2 against the turntable 1. The top ring 3 is located in an off-center position with respect to the turntable 1. The turntable 1 is rotatable about its own axis as indicated by the arrow A by a motor (not shown) which is coupled through a shaft 1*a* to the turntable 1. A polishing cloth 4 is attached to an upper surface of the turntable 1.

The top ring 3 is coupled to a motor (not shown) and also to a lifting/lowering cylinder (not shown). The top ring 3 is vertically movable and rotatable about its own axis as indicated by the arrows B, C by the motor and the lifting/lowering cylinder. The top ring 3 can therefore press the semiconductor wafer 2 against the polishing cloth 4 under a desired pressure. The semiconductor wafer 2 is attached to a lower surface of the top ring 3 under a vacuum or the like. A guide ring 6 is mounted on the outer circumferential edge of the lower surface of the top ring 3 for preventing the semiconductor wafer 2 from being disengaged from the top ring 3.

An abrasive liquid supply nozzle 5 is disposed above the turntable 1 for supplying an abrasive liquid onto the polishing cloth 4 attached to the turntable 1. A frame 11 is disposed around the turntable 1 for collecting the abrasive liquid and water which are discharged from the turntable 1. The frame 11 has a gutter 11*a* defined in a lower surface thereof for draining the abrasive liquid and water that has been discharged from the turntable 1.

A dressing head 8 for dressing the polishing cloth 4 is positioned above the turntable 1 in diametrically opposite relation to the top ring 3. The polishing cloth 4 is supplied with a dressing liquid such as water from a dressing liquid supply nozzle 10 extending over the turntable 1. The dressing head 8 is coupled to a motor (not shown) and also to a lifting/lowering cylinder (not shown). The dressing head 8 is vertically movable and rotatable about its own axis as indicated by the arrows D, E by the motor and the lifting/lowering cylinder.

The dressing head 8 is of a disk shape having substantially the same diameter as the top ring 3, and holds a dressing element 9 on its lower surface. The lower surface of the dressing head 8, to which the dressing element 9 is attached, has holes (not shown) defined therein which are connected to a vacuum source for attaching the dressing element 9 under vacuum to the lower surface of the dressing head 8.

The abrasive liquid supply nozzle 5 and the dressing liquid supply nozzle 10 extend to a region near the central axis of the turntable 1 above the upper surface thereof for supplying an abrasive liquid and a dressing liquid such as water, respectively, to the polishing cloth 4 at a predetermined position thereon.

The polishing apparatus operates as follows: The semiconductor wafer 2 is held on the lower surface of the top ring 3, and is pressed against the polishing cloth 4 on the upper surface of the turntable 1. The turntable 1 and the top ring 3 are rotated relatively to each other for thereby bringing the lower surface of the semiconductor wafer 2 in sliding contact with the polishing cloth 4. At this time, the abrasive liquid nozzle 5 supplies the abrasive liquid to the polishing cloth 4. The lower surface of the semiconductor wafer 2 is now polished by a combination of a mechanical polishing action of abrasive grains in the abrasive liquid and a chemical polishing action of an alkaline solution in the abrasive liquid. The abrasive liquid which has been applied to polish the semiconductor wafer 2 is scattered outwardly off the turntable 1 into the frame 11 under centrifugal forces caused by the turntable 1, and is collected by the gutter 11*a* in the lower surface of the frame 11.

The polishing process comes to an end when the semiconductor wafer 2 is polished by a predetermined thickness of a surface layer thereof. When the polishing process is finished, the polishing properties of the polishing cloth 4 are changed and the polishing performance of the polishing cloth 4 deteriorates. Therefore, the polishing cloth 4 is dressed to restore its polishing properties.

The polishing cloth 4 is dressed as follows: While the dressing head 8 with the dressing element 9 held on its lower surface and the turntable 1 are being rotated, the dressing element 9 is pressed against the polishing cloth 4 to apply a predetermined pressure to the polishing cloth 4. At the same time that or before the dressing element 9 contacts the polishing cloth 4, a dressing liquid such as water is supplied from the dressing liquid supply nozzle 10 to the upper surface of the polishing cloth 4. The dressing liquid is supplied for the purposes of discharging any abrasive liquid that remains on the polishing cloth 4 and removing frictional heat that is generated by the engagement between the dressing element 9 and the polishing cloth 4. The dressing liquid supplied to the polishing cloth 4 is then scattered outwardly off the turntable 1 into the frame 11 under centrifugal forces caused by the turntable 1, and is collected by the gutter 11*a* of the frame 11.

The dressing element 9 comprises a disk with diamond pellets (diamond particles) attached thereto. The dressing element 9 of such a structure is widely used if the polishing cloth 4 is made of polyurethane foam, and is effective to recover micropores in the upper surface of the polishing cloth 4 which has been loaded. The diamond pellets have a particle size ranging from #50 to #800, preferably from #100 to #200, for dressing the polishing cloth 4. If the particle size of the diamond pellets is larger than the above range, diamond particles would fall off from the disk, tending to fatally scratch the semiconductor wafer 2 while it is being polished. If the particle size of the diamond pellets is smaller than the above range, they would not be effective to dress the polishing cloth 4.

The dressing element 9 may alternatively comprise a disk with a brush of nylon or the like attached to a surface thereof. In a dressing process, the dressing element 9 of such a structure is held on the lower surface of the dressing head 8, and is pressed to dress the polishing cloth 4 while a dressing liquid such as water is being supplied to the upper surface of the polishing cloth 4.

When the dressing element 9 which comprises a disk with diamond pellets is used to dress the polishing cloth 4, diamond pellets may possibly fall off from the disk in the dressing process. If the semiconductor wafer 2 is polished by the polishing cloth 4 having diamond pellets which have fallen off from the disk and remain thereon, the semiconductor wafer 2 may possibly be scratched or damaged in the polishing process or a subsequent process such as a cleaning process. To avoid damage to the semiconductor wafer 2, after the polishing cloth 4 is dressed by the dressing element 9 with diamond pellets, the polishing cloth 4 should be dressed by a dressing element having a brush or cleaned by a water jet applied thereto. Therefore, the polishing cloth 4 may be dressed by a combination of different dressing elements. If a disk with diamond pellets and a disk with a brush which have the same diameter are used as dressing elements 9, then they may be replaceably mounted on the dressing head 8 for dressing the polishing cloth 4 in the two different modes described above.

Figure 2:
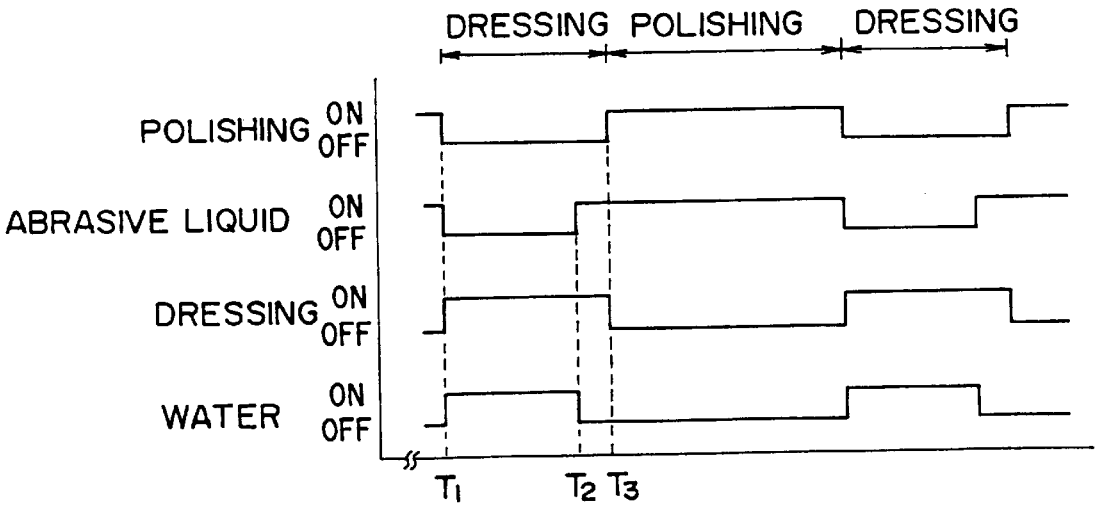
FIG. 2 is a timing chart of a sequence of dressing and polishing processes according to an embodiment of the present invention.

FIG. 2 shows a sequence of dressing and polishing processes. The timing of polishing the semiconductor wafer 2, supplying the abrasive liquid, dressing the polishing cloth 4, and supplying water will be described below with reference to FIG. 2. In FIG. 2, water is used as a dressing liquid.

At a time T1, a polishing process effected on the semiconductor wafer 2 by the polishing cloth 4 is finished and the supply of the abrasive liquid, e.g. from a source 5' through nozzle 5, is stopped, e.g. by operation of a control 20. The semiconductor wafer 2 which has been polished is transferred to a next process. The polishing cloth 4 which has polished the semiconductor wafer 2 is dressed in a dressing process as described above. Specifically, at the same time that or before the dressing element 9 contacts the polishing cloth 4, water is supplied, e.g. from a source 10', through the dressing liquid supply nozzle 10 to the upper surface of the polishing cloth 4, by operation of control 20.

At a time T2 in the dressing process, the supply of water from the dressing liquid supply nozzle 10 is stopped, and the abrasive liquid is supplied to the polishing cloth 4, e.g. by operation of control 20. The dressing process is finished after the abrasive liquid is supplied to the polishing cloth 4 by a predetermined period of time. Prior to a time T3 when a next polishing process is initiated, the supply of the abrasive liquid may be interrupted, or alternatively may be continued if a new semiconductor wafer 2 to be polished is held by the top ring 6, and the new semiconductor wafer 2 may then be polished. In FIG. 2, the new semiconductor wafer 2 starts being polished immediately after the dressing of the polishing cloth 4 is finished.

From the time T2 to the time T3, the polishing cloth 4 is dressed while it is being supplied with the abrasive liquid. Therefore, since the polishing cloth 4 is processed by the mechanical action of dressing, the abrasive liquid which has not yet been used to polish the semiconductor wafer 2 is well distributed over and impregnated in the polishing cloth 4. By operation of control 20, the abrasive liquid may begin to be supplied to the polishing cloth 4 at the time T1 so that the abrasive liquid is continuously supplied to the polishing cloth 4 at all times during the dressing process. However, the supply of the abrasive liquid during the entire dressing process is not preferable as the amount of the abrasive liquid would be too large.

As described above, when the dressing process is completed, the abrasive liquid which has not yet been used to polish the semiconductor wafer 2 is present on the polishing cloth 4. Consequently, the above dressing method can solve the problem of a low polishing rate which would otherwise be caused if an abrasive liquid were not present on the polishing cloth before the new workpiece starts being polished or the abrasive liquid were diluted by the water supplied in the dressing process.

Figure 3:
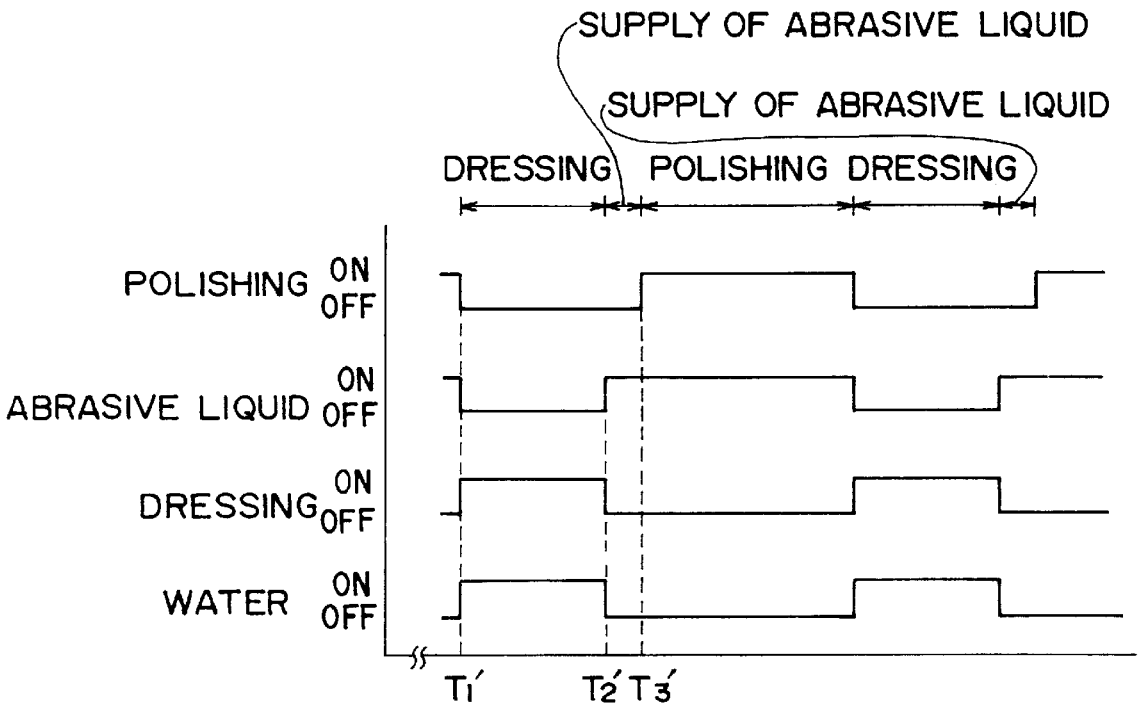
FIG. 3 is a timing chart of another sequence of dressing and polishing processes according to another embodiment of the present invention.

FIG. 3 shows another sequence of dressing and polishing processes. In the sequence shown in FIG. 3, the abrasive liquid is not supplied during the dressing process, but is supplied between the dressing and polishing processes. In FIG. 3, water is used as a dressing liquid.

As shown in FIG. 3, a polishing process effected on the semiconductor wafer 2 by the polishing cloth 4 is finished at a time T1', and the polishing cloth 4 is dressed while the polished semiconductor wafer 2 is being transferred to a next process. At the same time that or before the dressing element 9 contacts the polishing cloth 4, water is supplied from the dressing liquid supply nozzle 10 to the upper surface of the polishing cloth 4, by operation of control 20. Due to rotation of the turntable 1 during the dressing process, the water used to dress the polishing cloth 4 is scattered off the turntable 1 under centrifugal forces. After the polishing cloth 4 is dressed with the supplied water, the supply of water from the dressing liquid supply nozzle 10 is stopped at a time T2', by operation of control 20. Thereafter, the turntable 1 is stopped or rotated at a considerably low rotational speed, and the abrasive liquid is supplied to the polishing cloth 4 and distributed fully over the polishing cloth 4, by operation of control 20. Then, a next semiconductor wafer 2 starts being polished at a time T3'.

Between the time T2' and the time T3', neither a dressing process nor a polishing process is carried out, but the abrasive liquid is supplied to the polishing cloth 4 and distributed fully over the polishing cloth 4. If the time interval between the time T2' and the time T3' is positively present, the processing capability of the polishing apparatus per unit time is reduced. Therefore, such time interval should preferably be present if an optimum dressing time is shorter than a preparatory period in which the polished semiconductor wafer is detached from the top ring 6 and a new semiconductor wafer to be polished is attached to the top ring 6.

According to the sequence shown in FIG. 3, the abrasive liquid which has not yet been used to polish the semiconductor wafer 2 is supplied to the polishing cloth 4 before the next polishing process, and hence the fresh abrasive liquid is already present on the polishing cloth 4 for polishing the new semiconductor wafer 2. As a result, as with the sequence shown in FIG. 2, this dressing method can solve the problem of a low polishing rate which would otherwise be caused if an abrasive liquid were not present on the polishing cloth before the new workpiece starts being polished or the abrasive liquid were diluted by the water supplied in the dressing process.

In the sequences shown in FIGS. 2 and 3, a dressing process is inserted between every two polishing processes. However, if the polishing cloth 4 does not suffer a substantial degradation in its polishing capability after a polishing process, the polishing cloth 4 may be dressed once after it has polished a succession of several semiconductor wafers 2.

Although certain preferred embodiments of the present invention have been shown and described in detail, it should be understood that various changes and modifications may be made therein without departing from the scope of the appended claims.

What is claimed is:

1. A method of dressing a polishing cloth between a preceding polishing process for polishing a workpiece and a subsequent polishing operation for polishing another workpiece, said method comprising the steps of:

dressing said polishing cloth with a dressing element while supplying a dressing liquid to said polishing cloth; and supplying an abrasive liquid for polishing said another workpiece to said polishing cloth for a predetermined period of time prior to said subsequent polishing process;

said dressing liquid being of a different composition than said abrasive liquid and being capable of diluting said abrasive liquid.

2. A method according to claim 1, wherein said predetermined period of time is during said dressing step and immediately precedes said subsequent polishing process, and said dressing step is carried out while supplying said abrasive liquid to said polishing cloth.

3. A method according to claim 2, wherein said dressing liquid is not supplied during said predetermined period of time.

4. A method according to claim 1, wherein said predetermined period of time is between said dressing step and said subsequent polishing process.

5. A method according to claim 1, wherein said dressing step comprises pressing a dressing element having diamond pellets against said polishing cloth in the presence of said dressing liquid.

6. A method according to claim 1, wherein said dressing step comprises pressing a dressing element having a brush against said polishing cloth in the presence of said dressing liquid.

7. A method of manufacturing a semiconductor wafer, said method comprising dressing a polishing cloth with a dressing element while supplying a dressing liquid to a polishing cloth;

polishing a semiconductor wafer by a polishing apparatus; and supplying an abrasive liquid for polishing said semiconductor wafer to said polishing cloth for a predetermined period of time prior to said polishing process;

said dressing liquid being of a different composition than said abrasive liquid and being capable of diluting said abrasive liquid.

8. An apparatus for dressing a polishing cloth between polishing processes, each for polishing a workpiece, said apparatus comprising:

a dressing head for holding a dressing element to dress a polishing cloth;

a dressing liquid supply nozzle for supplying a dressing liquid used to dress the polishing cloth to the polishing cloth during a dressing process;

an abrasive liquid supply nozzle separate from said dressing liquid supply nozzle for supplying an abrasive liquid used to polish a workpiece to the polishing cloth during a polishing process; and the dressing liquid being of a different composition than the abrasive liquid and being capable of diluting the abrasive liquid; and means for controlling the supply of abrasive liquid from said abrasive liquid supply nozzle to ensure that the abrasive liquid is supplied to the polishing cloth for a predetermined period of time prior to the polishing process.

9. An apparatus according to claim 8, wherein said predetermined period of time is during said dressing process and immediately precedes said polishing process, and said abrasive liquid supply nozzle is operable to supply said abrasive liquid to the polishing cloth during said dressing process.

10. An apparatus according to claim 9, wherein said dressing liquid supply nozzle is operable to not supply said dressing liquid during said predetermined period of time.

11. An apparatus according to claim 8, wherein said predetermined period of time is between said dressing process and said polishing process.

12. An apparatus according to claim 8, wherein said dressing element comprises a disk with diamond pellets attached thereto.

13. An apparatus according to claim 8, wherein said dressing element comprises a disk with a brush attached thereto.

14. An apparatus for manufacturing a semiconductor wafer, said apparatus comprising:

a polishing apparatus for polishing a semiconductor wafer;

a dressing head for holding a dressing element to dress a polishing cloth;

a dressing liquid supply nozzle for supplying a dressing liquid used to dress the polishing cloth to the polishing cloth during a dressing process;

an abrasive liquid supply nozzle separate from said dressing liquid supply nozzle for supplying an abrasive liquid used to polish the semiconductor wafer to the polishing cloth during a polishing process; and the dressing liquid being of a different composition than said abrasive liquid and being capable of diluting said abrasive liquid; and means for controlling the supply of abrasive liquid from said abrasive liquid supply nozzle to ensure that the abrasive liquid is supplied to the polishing cloth for a predetermined period of time prior to the polishing process.

* * * * *